US008887344B2

(12) United States Patent
Bachar et al.

(10) Patent No.: US 8,887,344 B2
(45) Date of Patent: Nov. 18, 2014

(54) SILICONE BROOM AND A MANUFACTURING METHOD OF SILICONE BROOM

(76) Inventors: David Bachar, Petach Tiqua (IL); Dror Bachar, Petach Tiqua (IL)

( * ) Notice: Subject to any disclaimer, the term of this patent is extended or adjusted under 35 U.S.C. 154(b) by 0 days.

(21) Appl. No.: 13/996,117

(22) PCT Filed: Dec. 14, 2011

(86) PCT No.: PCT/IL2011/000943

§ 371 (c)(1),
(2), (4) Date: Jul. 31, 2013

(87) PCT Pub. No.: WO2012/085905

PCT Pub. Date: Jun. 28, 2012

(65) Prior Publication Data

US 2013/0298344 A1 Nov. 14, 2013

(30) Foreign Application Priority Data

Dec. 21, 2010 (IL) ..... 210135

(51) Int. Cl.

| | |
|---|---|
| ***A46B 1/00*** | (2006.01) |
| ***A46B 3/22*** | (2006.01) |
| ***A46B 15/00*** | (2006.01) |
| ***A46D 1/00*** | (2006.01) |
| ***A46D 3/00*** | (2006.01) |

(52) U.S. Cl.

CPC ... *A46B 1/00* (2013.01); *A46B 3/22* (2013.01); *A46B 15/00* (2013.01); *A46B 15/0081* (2013.01); *A46D 1/0207* (2013.01); *A46D 3/005* (2013.01); *A46B 2200/302* (2013.01)

USPC ..... 15/117; 15/187; 15/188; 264/134; 264/135

(58) Field of Classification Search

USPC ..... 15/117, 187, 188; 264/134, 135; 427/207.1, 402

See application file for complete search history.

(56) References Cited

U.S. PATENT DOCUMENTS 4,712,936 A * 12/1987 Kessler ..... 401/129
5,158,342 A * 10/1992 Pai ..... 300/21

(Continued)

FOREIGN PATENT DOCUMENTS

BR 10806122 A2 6/2010
DE 102005045575 A1 3/2007

(Continued)

OTHER PUBLICATIONS

International Search Report dated Apr. 24, 2012 in corresponding International Application No. PCT/IL2011/000943.

*Primary Examiner* — Monica Carter
*Assistant Examiner* — Michael Jennings
(74) *Attorney, Agent, or Firm* — The Law Office of Michael E. Kondoudis

(57) ABSTRACT

A sweeping device and method of manufacturing a silicone sweeping device. The sweeping device is made of silicone and includes: a silicone block with internal chassis; a plurality of downwardly silicone elongated bristles; and an upwardly projecting member containing a handle-receiving member with a cavity. The method of manufacturing a silicone sweeping device includes: providing a hard heat resistant chassis; providing a hard heat resistant cone with internal screw thread; drilling a hole into the center of the chassis; providing protective coating to the chassis; providing primer coating to the chassis; inserting the hard cone heat resistant tube as the handle receiving hole into the hole in the chassis; providing a mold including a mold cavity; placing the chassis into the mold cavity; processing the silicone in the mold into a final product; and applying secondary heat treatment in the oven.

11 Claims, 4 Drawing Sheets

(56) References Cited

U.S. PATENT DOCUMENTS

| | | | | |
|---|---|---|---|---|
| 5,966,771 | A * | 10/1999 | Stroud | 15/117 |
| 6,108,854 | A * | 8/2000 | Dingert | 15/188 |
| 6,266,839 | B1 * | 7/2001 | Oretti et al. | 15/117 |
| 6,374,449 | B1 * | 4/2002 | Jolly | 15/161 |
| 6,553,603 | B1 * | 4/2003 | Jolly | 15/161 |
| 7,373,686 | B2 * | 5/2008 | Foster et al. | 15/207.2 |
| 7,819,487 | B2 * | 10/2010 | Weaver | 300/21 |
| 2005/0060826 | A1 * | 3/2005 | Gavney, Jr. | 15/117 |
| 2006/0179594 | A1 * | 8/2006 | Yeung | 15/188 |
| 2007/0006411 | A1 * | 1/2007 | Foster et al. | 15/207.2 |
| 2007/0020396 | A1 * | 1/2007 | Erretby et al. | 427/294 |
| 2007/0054056 | A1 * | 3/2007 | Albert et al. | 427/387 |
| 2007/0143945 | A1 * | 6/2007 | DiPietro et al. | 15/188 |
| 2008/0073968 | A1 * | 3/2008 | Shiina | 300/21 |
| 2008/0286030 | A1 * | 11/2008 | Roder | 401/129 |
| 2010/0017987 | A1 * | 1/2010 | Lyons | 15/160 |
| 2011/0088188 | A1 * | 4/2011 | Ghodsi | 15/143.1 |
| 2011/0163572 | A1 * | 7/2011 | Campbell | 296/193.08 |

FOREIGN PATENT DOCUMENTS

| | | | |
|---|---|---|---|
| FR | 2506578 | A1 | 12/1982 |
| GB | 2150016 | A * | 6/1985 |
| WO | WO 9404057 | A1 * | 3/1994 |
| WO | WO/00/67610 | | 11/2000 |
| WO | WO 2009046725 | * | 4/2009 |

* cited by examiner

SILICONE BROOM AND A MANUFACTURING METHOD OF SILICONE BROOM a sweeping device made of silicone comprising: a silicone block with internal chassis; a plurality of downwardly silicone elongated bristles; an upwardly projecting member containing a handle-receiving member with cavity; and a method of manufacturing a silicone sweeping device, comprising: providing a hard heat resistant chassis; providing a hard heat resistant cone with internal screw thread; drilling a hole into the center of the chassis; providing protective coating to the said chassis; providing primer coating to the said chassis; inserting the hard cone heat resistant tube as the handle receiving hole into the hole in the chassis; providing a mold including a mold cavity; placing the chassis into the mold cavity; processing the silicone in the mold into a final product; applying secondary heat treatment in the oven.

FIELDS OF THE INVENTION

The invention will provide and implement a device and a method to manufacture the device such as silicone broom head in a one stage process.

BACKGROUND OF THE INVENTION

It has been ages for brooms to be extensively used for sweeping surfaces of many types and at many locations. One might still find brooms made of straws or thatch wrapped up on a round wood handle.

The most common brooms have a handle connected at its lower end to a broom head containing a mass of natural or synthetic fibers at its bottom generally arranged to form opposing spaced apart sides bristles.

The majority of brooms made these days by industrial process and made of wooden block or plastic block manufactured by several phases of production.

Newly innovated brooms are made of rubber parts in a process such as described in U.S. Pat. No. 6,108,854. U.S. Pat. No. 7,819,487 reveals a way to manufacture a silicone squeegee in several steps process and with different materials with different hardness.

Its been long time now for manufacturers to try and manufacture silicone brooms trying to utilize the advantages of the silicone such as high heat resistant, electrostatic characteristic, ease of cleaning, water and detergents resistant, its flexibility and none deformation characteristic.

The special skills and conditions required to work with silicone combined with the technical solutions need to be addressed during manufacturing process prevented manufacturers from making a silicone broom. Manufacturers encountered problems inter alia: the silicone brooms came out deformed and the handle reported to break away from the brooms' head.

OBJECTIVES OF THE INVENTION

Accordingly, several objects and advantages of the present invention are to provide a mean to overcome all of the foregoing problems aforementioned.

It is one objective of this invention to manufacture a silicone broom by single process, making it simpler and more reliable to produce.

It is another objective of this invention to manufacture a silicone broom by one process utilizing metal or metal alloy chassis implemented into the broom head before applying the silicone into the mold.

It is another objective of this invention to manufacture a silicone broom by single process utilizing a metal chassis implemented into the broom head before applying the silicone into the mold having special cavity to hold hard cone heat resistant tube with internal screw thread connected to its upper part making it possible to easily connect a broom stick handle.

It is another objective of the invention to manufacture a silicone broom with a squeegee silicone blade by one process.

The foregoing and additional objects physical features and advantages will become apparent from the following description and drawings:

DETAILED DESCRIPTION OF THE INVENTION

Figure 1:
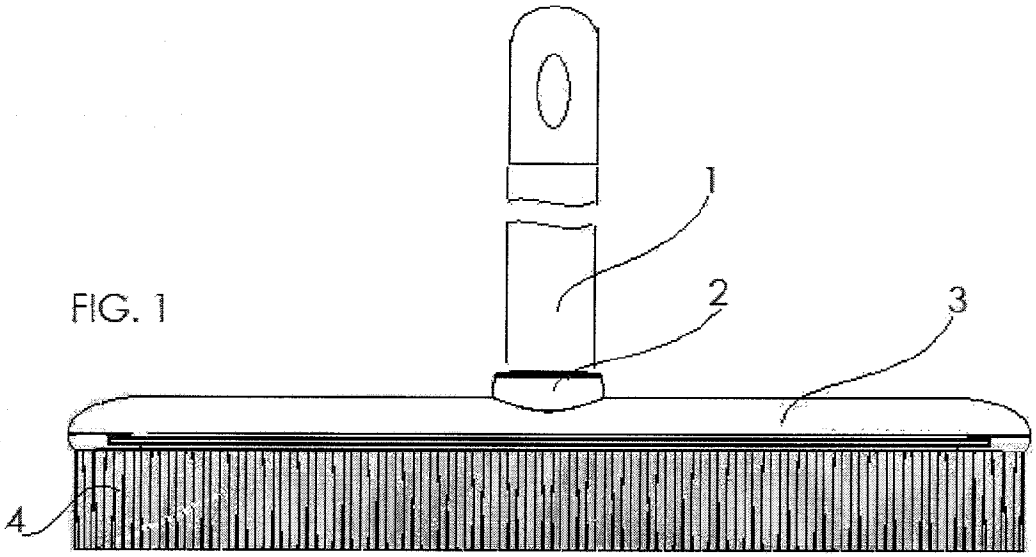
FIG. 1 illustrates one embodiment of a silicone broom comprises a broom stick handle (1) and a broom head (3) comprises plurality of bristles (4).
Figure 2:
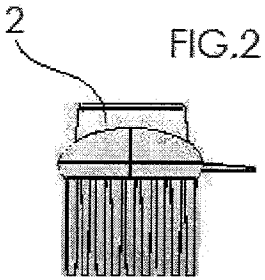
FIG. 2 illustrates side view of one embodiment of a silicone broom with squeegee blade (8).
Figure 3:
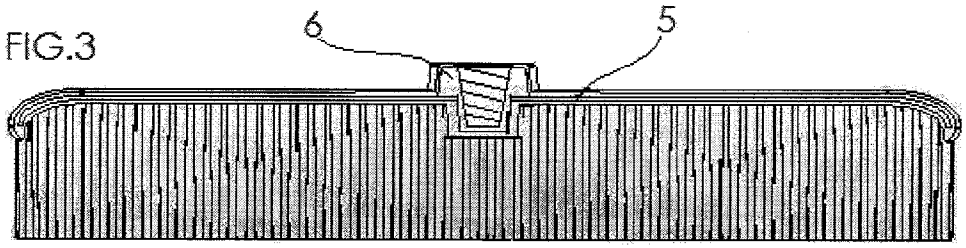
FIG. 3 illustrates a side cross-section of one embodiment revealing the chassis (5) embedded into the head section of the silicone broom and the hard cone heat resistant tube with internal screw thread (6) as a handle-receiving member.
Figure 4:
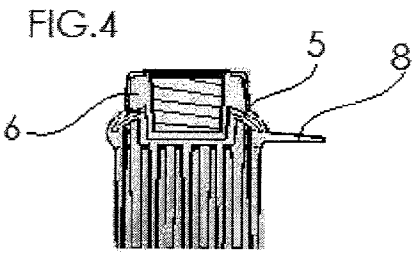
FIG. 4 illustrated a side cross-section of one embodiment of a silicone broom revealing the chassis (5) embedded into the head section of the silicone broom, the hard cone heat resistant tube with internal screw thread (6) and the squeegee blade (8).
Figure 5:
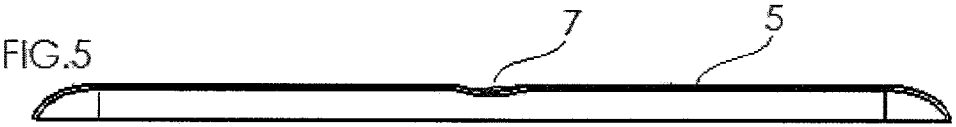
FIG. 5 illustrates one embodiment of a chassis (5) with a cavity (7) to contain the hard cone heat resistant tube with internal screw thread that supports the brooms' stick handle according to one embodiment.
Figure 6:
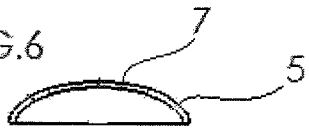
FIG. 6 illustrates a side view of the chassis according to one embodiment of a silicone broom.
Figure 7:
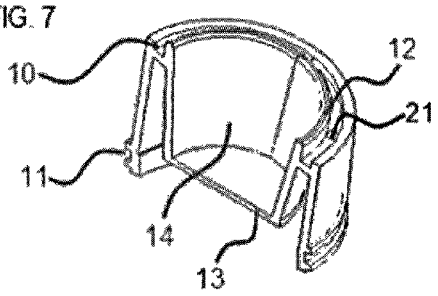
FIG. 7 illustrates the cross-section of one embodiment of the hard cone heat resistant tube with internal screw thread that connects the head of the silicone broom to the brooms' stick handle utilizing standard broom stick screw.
Figure 8:
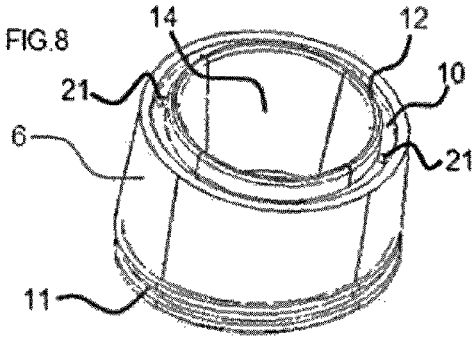
FIG. 8 is a detailed view of one embodiment of the hard cone heat resistant tube with internal screw thread.
Figure 9:
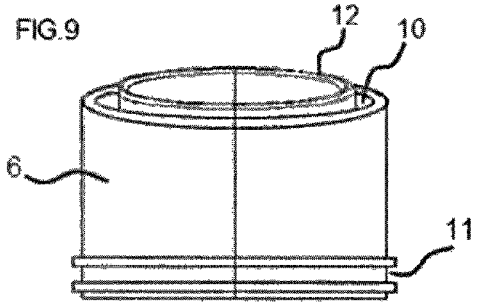
FIG. 9 is a side view of one embodiment of the hard cone heat resistant tube with internal screw thread.

An overall view of currant device and method according to one embodiment of present invention will be described hereafter:

providing a hard heat resistant chassis (5) in this embodiment made of aluminum; Drilling a hole (7) into the center of the chassis.

providing protective coating to the said chassis in this embodiment by alodining process.

providing a hard cone heat resistant tube (FIG. 7) with internal screw thread (14) in this embodiment made of fiber nylon alloy.

Figure 10:
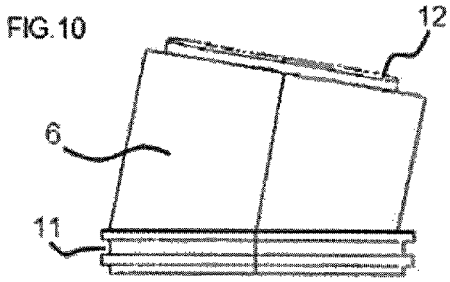
FIG. 10 is another side view of one embodiment of the hard cone heat resistant tube with internal screw thread

The hard cone heat resistant tube broom can be connected perpendicular to the chassis top or it can be slanted thereto (FIG. 10).

inserting the hard cone heat resistant tube as the handle receiving hole into the hole in the chassis; in a way were the slot (11) is pushed into the cavity in the chassis (7) making the upper and lower rim of the said slot tighten the said cone to the chassis.

Another method used in this embodiment to tighten the cone to the chassis is the special structure of the cone were the inner wall (12) elevated from the total exterior wall (6) enabling the silicone to wrap the cone in a way that during the injection process the silicone is overflow spills over the exterior wall (6) into the upper slot (10) wrapping the elevated inner wall (12).

Another method used in this embodiment to tighten the cone to the chassis are the plurality of holes made in the slot (10) were the elevated inner wall (12) connected to the external wall (6) of the handle receiving wall.

These plurality of connecting holes (21) allow silicone fluid to pass through in the injection process bonding the upper part of the handle-receiving member with the sweeping device head providing stronger grip of the a handle-receiving member in the head portion of the device.

Figure 12:
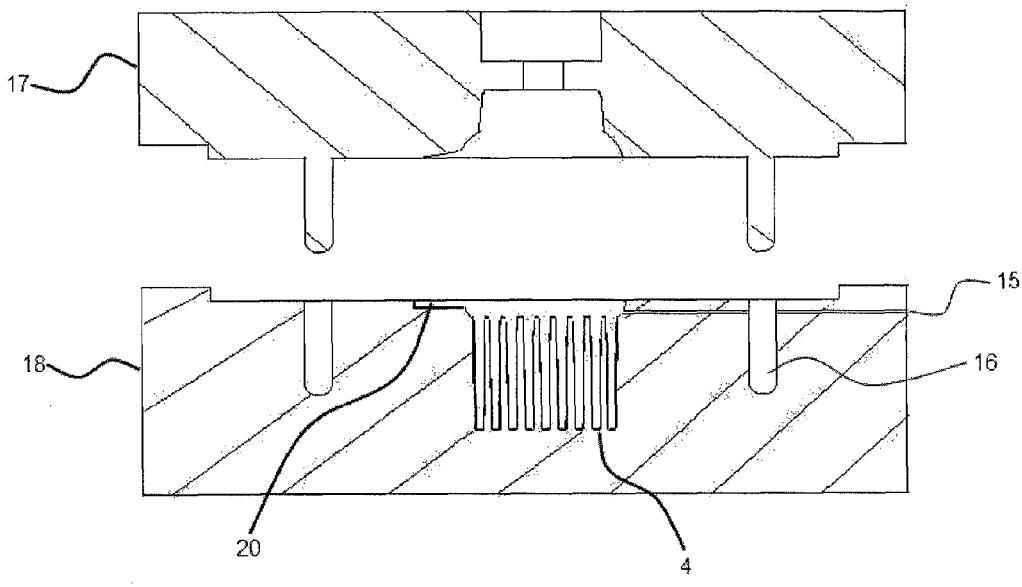
FIG. 12 illustrates one embodiment of the mold in its open positioning with nothing in it.
Figure 13:
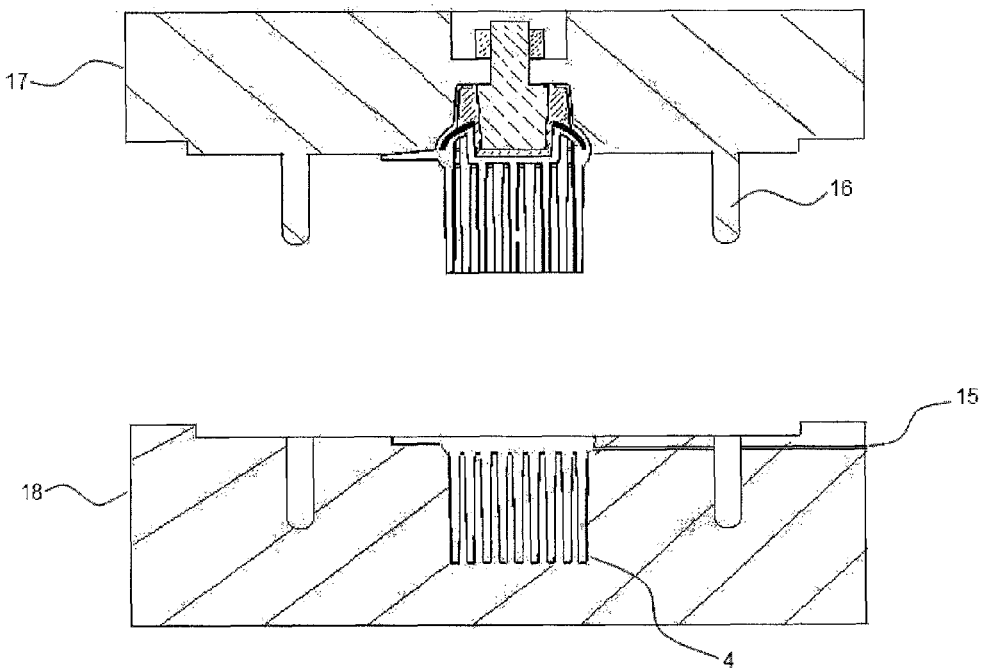
FIG. 13 illustrates one embodiment of the mold in its open positioning after the molding process.
Figure 14:
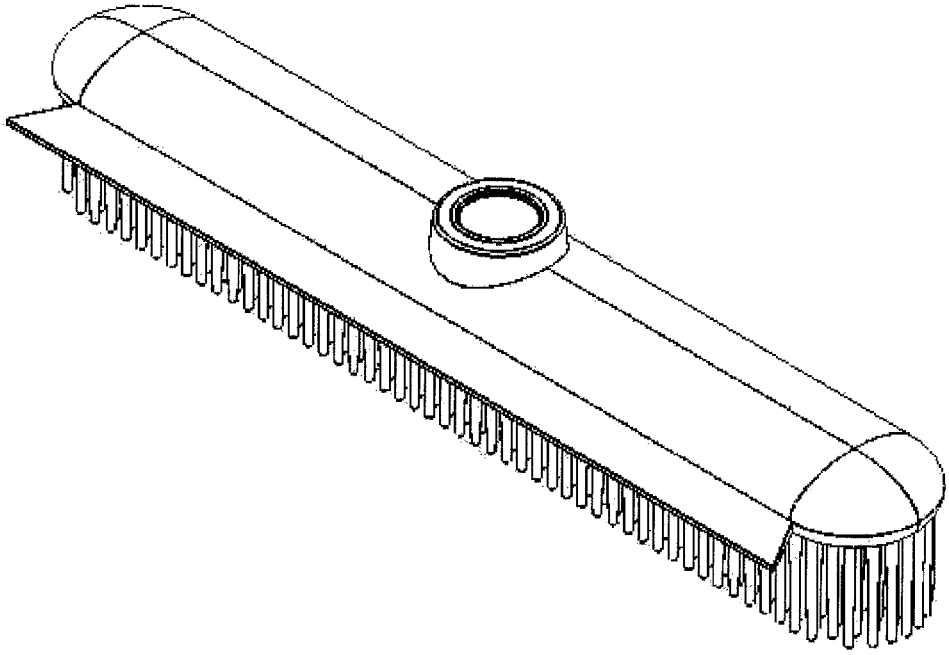
FIG. 14 illustrates the isometric view of one embodiment of this invention

Providing a steel mold (FIG. 12) including a mold cavity; Assembly of the handle-receiving member on the chassis by pressing in or half-turning.

Figure 11:
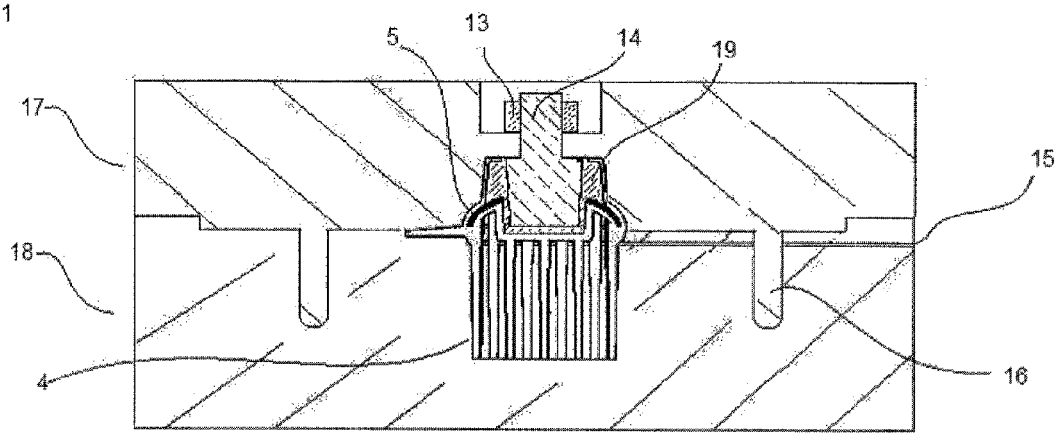
FIG. 11 illustrates one embodiment of the mold in its closed positioning

Placing the chassis (5) with the handle-receiving member (FIG. 7-10) into the mold cavity (FIG. 11).

Casting of silicone rubber on the chassis including the handle-receiving member in a steel mold die-casting of the broom in the press—according to a dosing process. The frame and holder together with the liquid silicone mixture in plastic state at final weight are manually introduced into the steel mold (at 250 atm. and 200° C. for several minutes) to vulcanize the product (elastometric state).

After completion of the vulcanize process in the mold, the product is usually subjected to a secondary heat treatment in the oven (about 6 hours at 200° C.) for enhanced final properties.

The protective coating can be but is not limited to anodization. The chassis can be, but is not limited to, paint coated with primer enables better bonding with the silicone. A curve can be, but is not limited to being, made in the chassis alongside the elongate axis of the chassis. The hard cone can be, but is not limited to being, made of reinforced plastic such as fiberglass-nylon; and any combination thereof

SUMMARY OF THE INVENTION

Although many tried to manufacture a silicone broom in one piece and in one injection process, none fulfilled the mission to do so. By using the method and analyzing the device as described in this patent, such a mission can be accomplish with no difficulties.

While the invention has been described with much specificity, it will be understood that this description is only intended to provide an illustration for some of the presently preferred embodiments of this invention and not to limit its scope. Many other ramifications are possible.

What is claimed is:

1. A sweeping device made of silicone comprising:

a silicone block with internal chassis;

a plurality of downwardly silicone elongated bristles; and an upwardly projecting member containing a handle-receiving member with cavity;

wherein said internal chassis is made of a first hard material, further wherein said handle receiving member is made of a second hard material, and further wherein said handle receiving member fits tightly into a hole in the center of said internal chassis further wherein said internal chassis is provided with a protective coating, said protective coating selected from a group consisting of: an alodined coating, an anodized coating, and any combination thereof, said handle-receiving member comprising an elevated inner wall, and said elevated inner wall being connected to the external wall of the handle receiving wall with a slot.

2. The sweeping device according to claim 1, wherein the sweeping device is a broom.

3. The sweeping device according to claim 1, wherein said silicone block is an elongated molded head portion having opposing side walls, end walls, an upper surface and a lower surface.

4. The sweeping device according to claim 1, wherein the internal chassis made of hard material.

5. The sweeping device according to claim 4, wherein said hard material is made of metal alloy such as aluminum.

6. The sweeping device according to claim 4, wherein said hard material is heat resistant material resisting to temperature of up to 200 Celsius.

7. The sweeping device comprises an internal chassis according to claim 1, wherein at least one of the following is being held true (a) the internal chassis is a curved chassis; (b) wherein said sweeping device comprises a plurality of bristles; further wherein said plurality of bristles are integrally formed bristles at the lower surface of said silicone block; (c) said sweeping device comprises an upwardly projecting member; said projecting member is perpendicular to the top of said silicone block; (d) wherein said sweeping device comprises an upwardly projecting member; said projecting member is slanted relative to the top of said silicone block; (e) said handle-receiving member is selected from a group consisting of reinforced plastic, fiberglass-nylon and any combination thereof; and any combination thereof.

8. The sweeping device according to claim 1, wherein said sweeping device comprises a slot with plurality of connecting holes to allow silicone fluid to pass through in the injection process bonding the upper part of the handle-receiving member with the sweeping device head providing stronger grip of the handle-receiving member in the head portion of the device.

9. The sweeping device according to claim 1, further wherein a plurality of rods jutting out of the exterior peripheral forming slots for better grip to the silicone.

10. The sweeping device according to claim 1, comprises a squeegee.

11. The sweeping device according to claim 10, wherein the squeegee is part of the silicone block at the elongated wall of the molded head portion.

* * * * *